US007019696B2

(12) United States Patent
Jenwatanavet

(10) Patent No.: US 7,019,696 B2
(45) **Date of Patent: *Mar. 28, 2006**

(54) TRI-BAND ANTENNA

(75) Inventor: Jatupum Jenwatanavet, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 23 days.

This patent is subject to a terminal disclaimer.

(21) Appl. No.: 10/818,063

(22) Filed: Apr. 5, 2004

(65) Prior Publication Data

US 2004/0189534 A1 Sep. 30, 2004

Related U.S. Application Data

(63) Continuation of application No. 10/228,693, filed on Aug. 26, 2002, now Pat. No. 6,741,213.

(51) Int. Cl.
*H01Q 1/38* (2006.01)
*H01Q 1/36* (2006.01)

(52) U.S. Cl. ..... 343/700 MS; 343/895

(58) Field of Classification Search ..... 343/700 MS, 343/702, 846, 873, 895; H01Q 1/38, 1/36
See application file for complete search history.

(56) References Cited

U.S. PATENT DOCUMENTS

| | | | | |
|---|---|---|---|---|
| 6,741,213 | B1 * | 5/2004 | Jenwatanavet | 343/700 MS |
| 2003/0006936 | A1 * | 1/2003 | Aoyama et al. | 343/700 MS |
| 2003/0092420 | A1 * | 5/2003 | Sugimoto et al. | 455/333 |

* cited by examiner

*Primary Examiner*—Hoanganh Le

(57) ABSTRACT

A tri-band antenna and method for forming the same are disclosed. The antenna comprises a meander line radiator, a tapered line radiator coupled to the meander line radiator, a straight line radiator coupled to the tapered line radiator, and a dielectric layer. Exemplary meander line, tapered line, and straight line radiators are formed as microstrip structures overlying the dielectric layer surfaces. According to one embodiment, the meander line radiator is formed on the dielectric top surface and is connected to the tapered line radiator on the dielectric bottom surface through a via. The straight line radiator is connected to the tapered line radiator output on the bottom surface, and is unterminated. In one aspect, the combination of the meander line radiator, tapered line radiator, and straight line radiator forms effective electrical lengths corresponding to the cellular frequency band, the GPS frequency band, and the PCS frequency band.

29 Claims, 5 Drawing Sheets

TRI-BAND ANTENNA

RELATED APPLICATIONS

This is a continuation of U.S. Application No. 10/228,693, filed Aug. 26, 2002, now U.S. Pat. No. 6,741,213, the disclosure of which is hereby incorporated by reference.

BACKGROUND OF THE INVENTION

1. Field of the Invention

This invention generally relates to wireless communications antennas and, more particularly, to a tri-band antenna that resonates at three non-harmonically related frequencies.

2. Related Art

The size of wireless communications devices, such as wireless telephones, continues to shrink, even as users demand more functionality. One consequence of this tension between size and function is the pressure for manufactures to make smaller antennas. This pressure is compounded if the wireless device is expected to operate in a plurality of frequency ranges. Many wireless telephones, for example, are expected to operate in the cellular band of 824 to 894 megahertz (MHz), the PCS band of 1850 to 1990 MHz, and to receive global positioning satellite (GPS) signals in the band of 1565 to 1585 MHz. Other telephonic devices are also expected to operate in the Bluetooth band of 2400 to 2480 MHz.

It would be advantageous if a small microstrip antenna could be designed to resonate at three distinct non-harmonically related frequencies.

It would be advantageous if the above-mentioned microstrip antenna could be designed to operate in the cellular, GPS, and PCS bands.

SUMMARY OF THE INVENTION

The present invention describes a microstrip design antenna that resonates at three discrete, non-harmonically related frequencies. An example is given of an antenna that resonates in the frequency bands of 824 to 894 MHz, 1565 to 1585 MHz, and 1850 to 1990 MHz. This antenna has the further advantage of being very small and, therefore, useable with a portable wireless device or laptop computer.

Accordingly, a tri-band antenna is provided comprising a meander line radiator, a tapered line radiator, a straight line radiator, and a dielectric layer having top surface and a bottom surface. Each dielectric layer surface has an area of less than $1.0\times10^6$ square mils (mils$^2$). The meander line, tapered line, and straight line radiators are formed as microstrip structures overlying the dielectric layer top and bottom surfaces.

More specifically, the meander line radiator is formed on the dielectric top surface and has an input connected to a transmission line feed. The meander line is connected to the tapered line radiator on the dielectric bottom surface through a via. The straight line radiator is connected to the tapered line radiator output on the bottom surface, and is unterminated.

In one aspect, the combination of the meander line radiator, tapered radiator, and straight line radiator forms a first effective electrical length corresponding to the cellular frequency band, a second effective electrical length corresponding to the GPS frequency band, and a third effective electrical length corresponding to the PCS frequency band.

Additional details of the above-described tri-band antenna, and a method for forming a tri-band electromagnetic radiator are provided below.

DETAILED DESCRIPTION OF THE INVENTION

Figure 1:
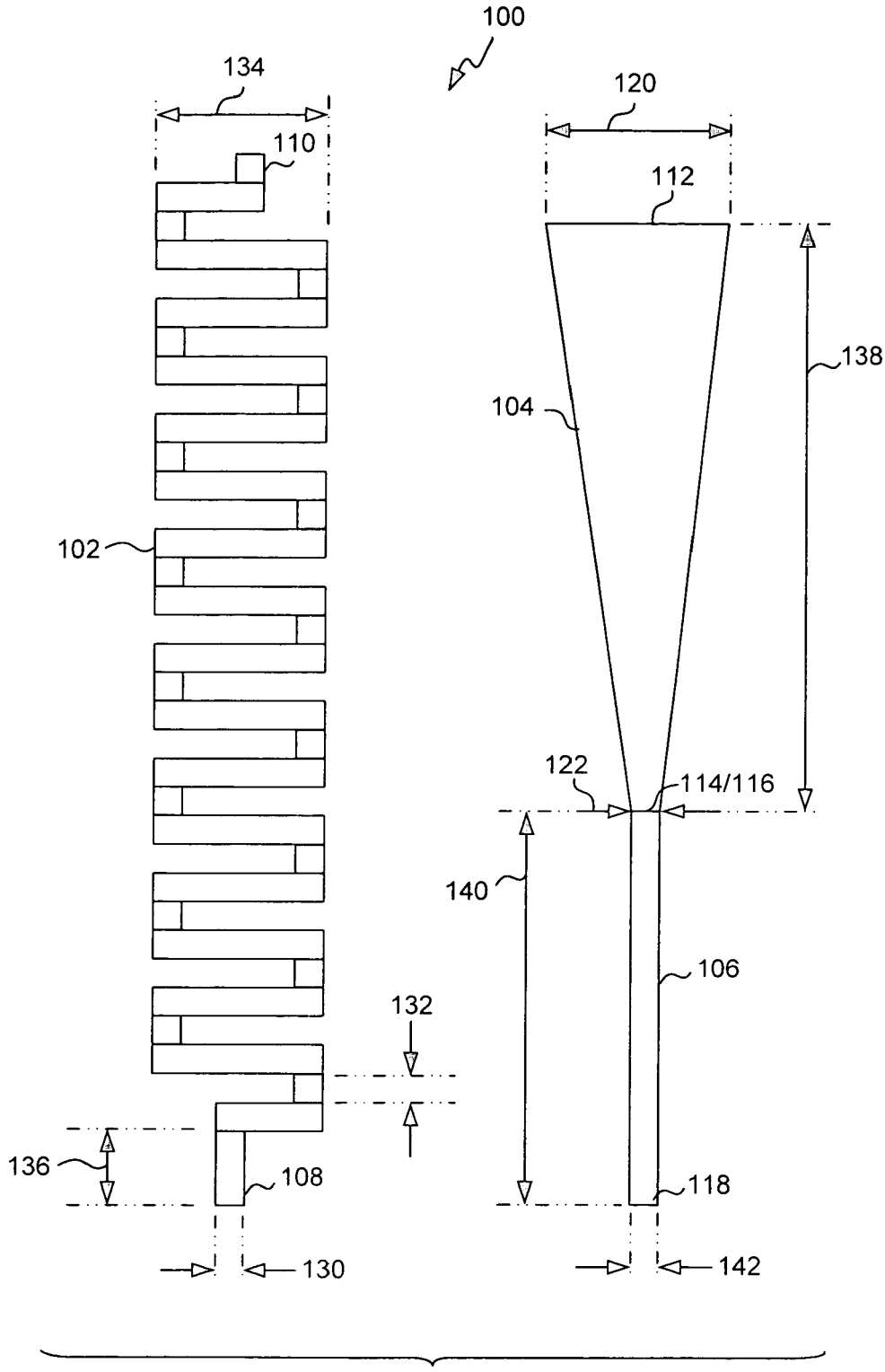
FIG. 1 includes abstracted views of the present invention tri-band antenna.

FIG. 1 includes abstracted views of the present invention tri-band antenna. The antenna 100 comprises a meander line radiator 102, a tapered line radiator 104, and a straight line radiator 106.

Figure 2A:
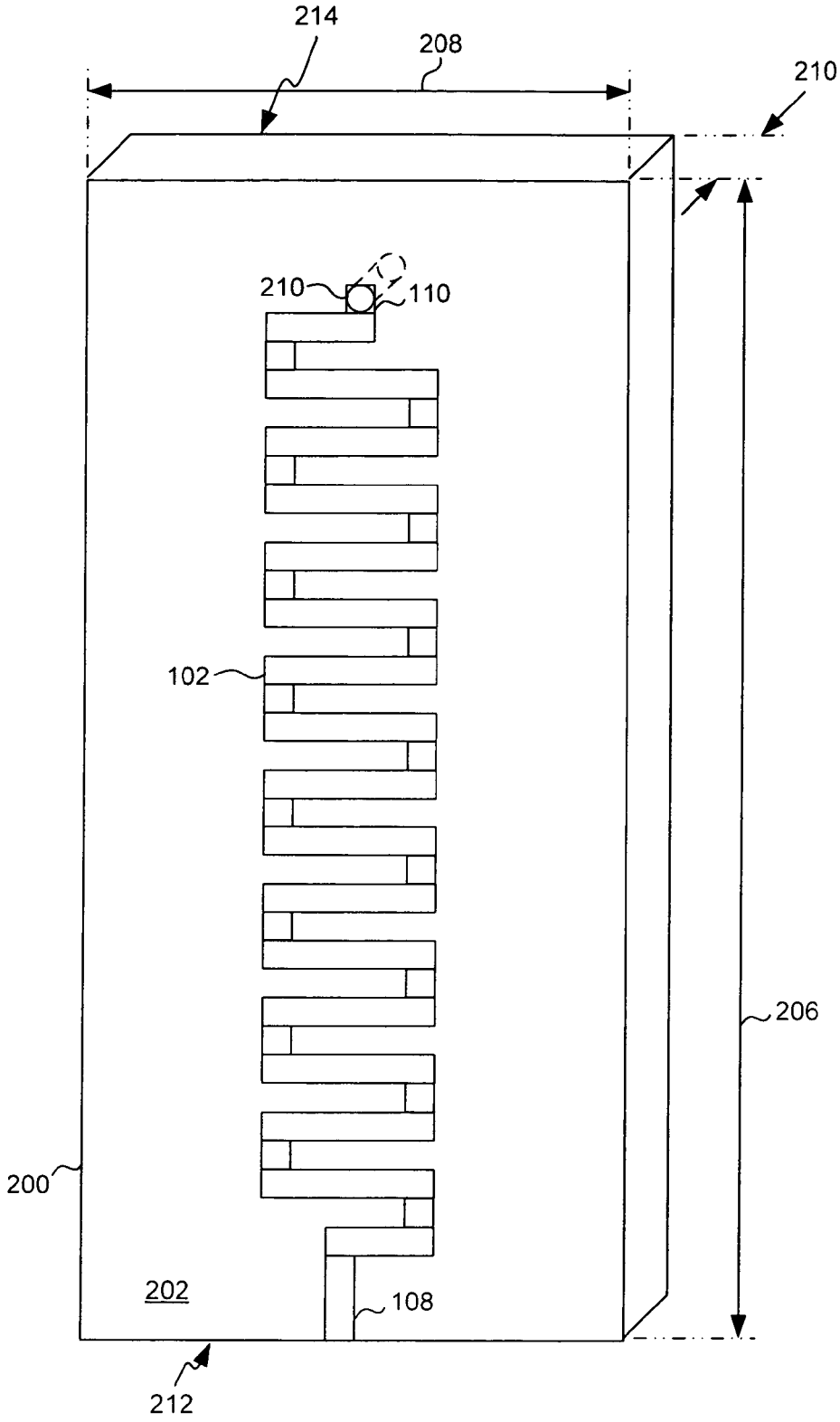
FIGS. 2A and 2B are perspective drawings of the present invention antenna of FIG. 1.
Figure 2B:
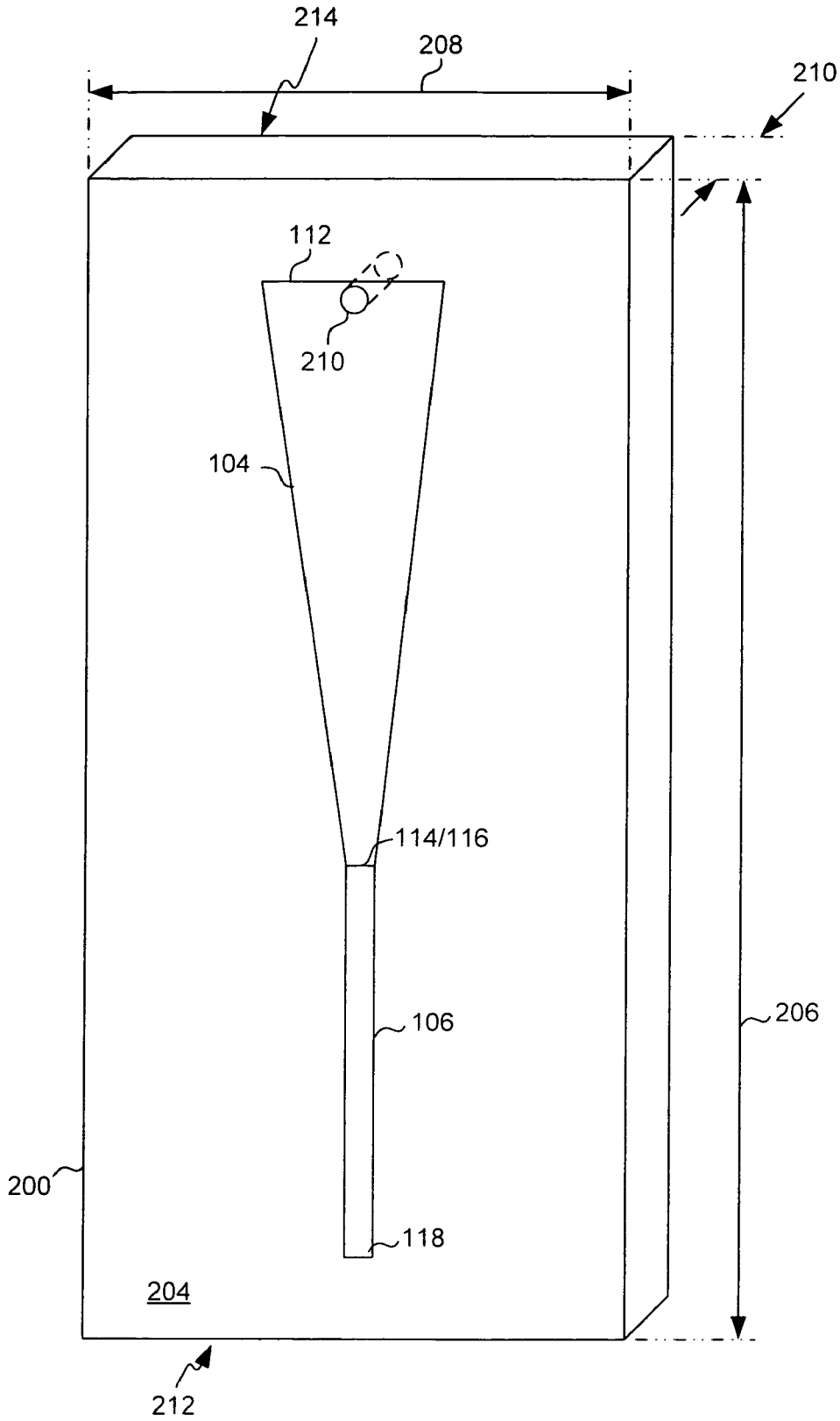

FIGS. 2A and 2B are perspective drawings of the present invention antenna 100 of FIG. 1. In FIG. 2A, α dielectric layer 200 is shown having top surface 202. In FIG. 2B the dielectric layer bottom surface 204. Each surface 202/204 has an area of less than $1.0\times10^6$ square mils. In one example of the antenna 100, each surface 202/204 has a length 206 of 1910 mils, a width 208 of 420 mils, and a thickness 210 of 32 mils. To continue the example, the dielectric layer can be FR4 material with a dielectric constant of 4. However, the present invention antenna is not limited to any particular dielectric material or set of dimensions.

The meander line 102, tapered line 104, and straight line 106 radiators overlie the dielectric layer top and bottom surfaces 202/204. In some aspects, the meander line 102, tapered line 104, arid straight line 106 radiators are microstrip structures overlying the dielectric layer top and bottom surfaces 202/204. To continue the above example, the lines 102/104/106 can be formed from half-ounce copper. However, the present invention antenna is not limited to any particular conductor or conductor thickness.

Returning to FIG. 1, the meander line radiator 102 has an input 108 connected to a transmission line feed (not shown), and an output 110. The transmission line feed can be a coax cable, microstrip, or stripline for example. The tapered line radiator 104 has an input 112 connected to the meander line radiator output 110, and an output 114. The straight line radiator 106 has an input 116 connected to the tapered line radiator output 114, and an unterminated output 118.

The tapered line radiator 104 has a first line width 120 at the input 112 and a second line width 122 at the output 114, less than the first line width 120. In some aspects as shown, the tapered line radiator 104 has a width that linearly varies from the first line width 120 to the second line width 122. However, the present invention antenna is not limited to any type of taper. In other aspects not shown, the taper can change exponentially or change step-wise.

As shown in FIG. 2A, the meander line radiator 102 is formed on the dielectric layer top surface 202. As shown in FIG. 2B, the tapered line radiator 104 and the straight line radiator 106 are formed on the dielectric layer bottom surface 204. Viewing both figures, the dielectric layer 200 includes a conductive via 210 (shown with dotted lines through the dielectric material) between the top surface 202 and the bottom surface 204. The meander line radiator output 110 is connected to the via 210 on the dielectric layer top surface 202 and the tapered line radiator input 112 is connected to the via 210 on the dielectric layer bottom surface 204.

The dielectric layer 200 has a first end 212 and a second end 214, with the via 210 located proximate to the second end 214. The meander line radiator input 108 is formed at the dielectric layer first end 212 and the output 110 is formed at the dielectric layer second end 214. The tapered line radiator input 112 is formed at the dielectric layer second end 214 and the straight line radiator output 118 is located proximate to the dielectric layer first end 212.

The combination of the meander line radiator 102, tapered line radiator 104, and straight line radiator 106 forms a first effective electrical length corresponding to a first frequency, a second effective electrical length corresponding to a second frequency, non-harmonically related to the first frequency, and a third effective electrical length corresponding to a third frequency, non-harmonically related to the first and second frequencies. To continue the example begun above, the combination of the meander line radiator 102, tapered line radiator 104, and straight line radiator 106 forms effective electrical lengths corresponding to frequencies in the ranges of approximately 824 to 894 megahertz (MHz), 1565 to 1585 MHz, and 1850 to 1990 MHz.

Returning to FIG. 1, the meander line radiator 102 has a line width 130, a first line length per turn 132, a second line length per turn 134, a line leader length 136, and a number of turns. The tapered line radiator 104 has a line length 138. The straight line radiator 106 has a line length 140 and a line width 142. To finish the example started above, the meander line radiator line width 130 is 31.25 mils, the first line length per turn 132 is 20 mils, the second line length per turn 134 is 322 mils, the line leader length 136 is 220 mils, and there are 13 turns. More specifically, there are 12 full turns and 2 half-turns. The tapered line radiator 104 has a first line width 120 of 322 mils, and second line width 122 of 31.25 mils, and a line length 138 of 1160 mils. The straight line radiator 106 has a line length 140 of 440 mils and a line width 142 of 31.25 mils. The above-mentioned dimensions are approximate in the sense that they can vary in response to materials, changes in the dimensions of coupling conductors, or changes in the dimensions of the dielectric material.

Figure 4:
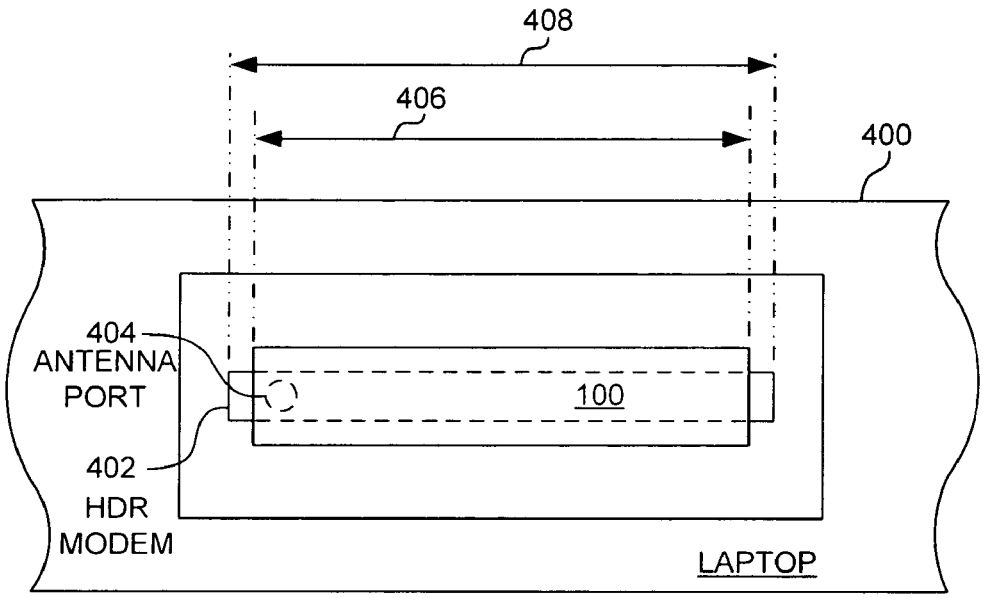
FIG. 4 is a side view of a conventional laptop computer utilizing the present invention tri-band antenna.

FIG. 4 is a side view of a conventional laptop computer utilizing the present invention tri-band antenna. In some aspects, the tri-band antenna 100 is used in a wireless communications system comprising a microprocessor subsystem 400, such as a laptop computer (as shown) or a dedicated function microprocessor device. A high data rate (HDR) modem 402, depicted with dashed lines behind the antenna 100, is connected to the microprocessor subsystem 400, and has an antenna port 404 suitable for wireless communications. The tri-band antenna 100 is connected the HDR antenna port 404 for communication in the above-mentioned frequency bands. The antenna fits within the form factor of a standard HDR modem. That is, the length 406 of the antenna 100 is less than the width 408 of the conventional HDR modem card 402. Conventional modem cards have a standard width, connector, and form factor to mate into the provided slots of a conventional laptop computer.

Figure 3:
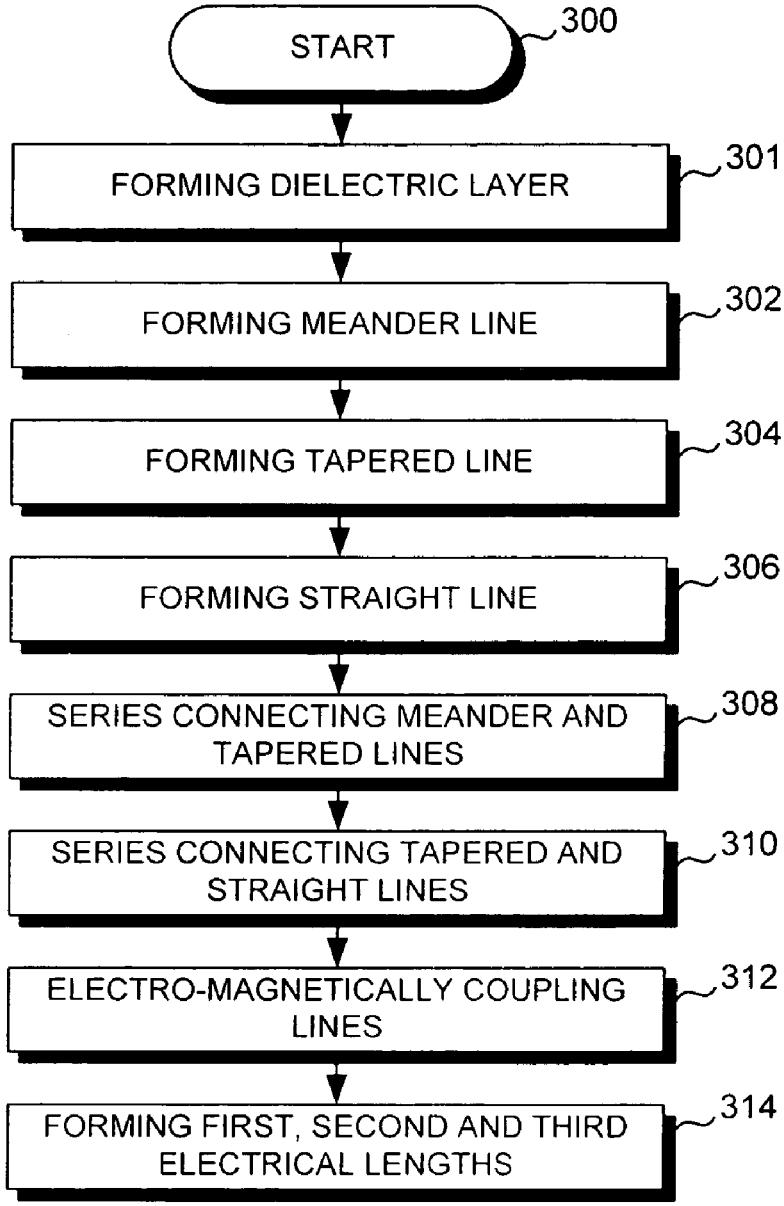
FIG. 3 is a flowchart illustrating the present invention method for forming a tri-band electromagnetic radiator.

FIG. 3 is a flowchart illustrating the present invention method for forming a tri-band electromagnetic radiator. Although this method is depicted as a sequence of numbered steps for clarity, no order should be inferred from the numbering unless explicitly stated. It should be understood that some of these steps may be skipped, performed in parallel, or performed without the requirement of maintaining a strict order of sequence. The method starts at Step 300. Step 302 forms a conductive meander line. Step 304 forms a conductive tapered line. Step 306 forms a conductive straight line. Step 308 series connects the meander line to the tapered line. Step 310 series connects the tapered line to the straight line. Step 312 electromagnetically couples the meander line to the tapered line and the straight line.

In some aspects of the method, forming the tapered line in Step 304 includes forming a first line width at an input and a second line width at an output, less than the first line width. In other aspects Step 304 forms a line width that linearly varies from the first line width to the second line width.

Some aspects of the method include a further step. Step 301 forms a dielectric layer having a first surface and a second surface. Forming the meander line in Step 302 includes forming a microstrip meander line overlying the dielectric layer first surface. Forming the tapered line in Step 304 includes forming a microstrip tapered line overlying the dielectric layer second surface. Forming the straight line in Step 306 includes forming a microstrip straight line overlying the dielectric layer second surface. Then, electromagnetically coupling the meander line to the tapered line and the straight line in Step 312 includes coupling through the dielectric layer.

In other aspects, series connecting the meander line to the tapered line in Step 308 includes using a dielectric layer conductive via to connect between the meander line overlying the dielectric layer first surface and the tapered line overlying the dielectric layer second surface.

Some aspects of the method include a further step. Step 314, in response to the combination of the meander line, the tapered line, and the straight line, forms a first effective electrical length corresponding to a first frequency, a second effective electrical length corresponding to a second frequency, non-harmonically related to the first frequency, and a third effective electrical length corresponding to a third frequency, non-harmonically related to the first and second frequencies. In other aspects, forming first, second, and third effective electrical lengths in Step 314 includes forming effective electrical lengths corresponding to frequencies in the ranges of approximately 824 to 894 megahertz (MHz), 1565 to 1585 MHz, and 1850 to 1990 MHz.

In other aspects, forming the meander line in Step 302 includes increasing the number of turns in the meander line. Then, forming first, second, and third effective electrical lengths corresponding to first, second, and third frequencies in Step 314 includes increasing the first effective electrical length to lower the first frequency. The opposite effect on frequency is observed if the number of turns in the meander line is decreased.

In some aspects, forming the tapered line in Step 304 includes decreasing the tapered line first width. Then, forming first, second, and third effective electrical lengths corresponding to first, second, and third frequencies in Step 314 includes decreasing the first, second, and third effective electrical lengths to increase the first, second, and third frequencies. The opposite effect on frequency is observed if the tapered line first line width is increased.

In other aspects, forming the tapered line in Step 304 includes decreasing the length of the tapered line. Then, forming first, second, and third effective electrical lengths corresponding to first, second, and third frequencies in Step 314 includes decreasing the first, second, and third effective electrical lengths to increase the first, second, and third frequencies. The opposite effect on frequency is observed if the length of the tapered line is increased.

In some aspects, forming the straight line in Step 306 includes decreasing the length of the straight line. Then, forming first, second, and third effective, electrical lengths corresponding to first, second, and third frequencies in Step 314 includes decreasing the third effective electrical length to increase the third frequency. The opposite effect on frequency is observed if the length of the straight line is increased.

In other aspects, forming the dielectric layer in Step 301 includes increasing the dielectric layer thickness. Then, forming first, second, and third effective electrical lengths corresponding to first, second, and third frequencies in Step 314 includes decreasing the first, second, and third effective electrical lengths, thereby increasing the first, second, and third frequencies, in response to increasing the dielectric layer thickness. The opposite effect on frequency is observed if the thickness of the dielectric is decreased.

A tri-band antenna and method for forming the same have been presented. A specific example has been provided of an antenna that resonates at the cellular band, GPS, and PCS band frequencies. However, it should be understood that present invention antenna is not limited to any particular frequencies, materials, or dimensions. Other variations and embodiments of the invention will occur to those skilled in the art.

What is claimed is:

1. A tri-band antenna comprising:

a meander line radiator;

a tapered line radiator coupled to the meander line radiator, the tapered line radiator defined by two sides, each of which taper from a first end to define a first line width of the tapered line radiator to a second end to define a second line width of the tapered line radiator;

a straight line radiator coupled to the tapered line radiator; and, wherein the meander line, tapered line, and straight line radiators are non-coplanar oriented.

2. The antenna of claim 1 further comprising:

a dielectric layer having top surface and a bottom surface, each surface having an area of less than $1.0\times10^6$ square mils ($mils^2$); and, wherein the meander line, tapered line, and straight line radiators overlie the dielectric layer top and bottom surfaces.

3. The antenna of claim 1 further comprising:

a dielectric layer having top surface and a bottom surface; and, wherein the meander line, tapered line, and straight line radiators are microstrip structures overlying the dielectric layer top and bottom surfaces.

4. The antenna of claim 3 wherein the meander line radiator has an input connected to a transmission line feed, and an output;

wherein the tapered line radiator has an input connected to the meander line radiator output, and an output; and, wherein the straight line radiator has an input connected to the tapered line radiator output, and an unterminated output.

5. The antenna of claim 4 wherein the second line width of the tapered line radiator is less than the first line width of the tapered line radiator.

6. The antenna of claim 1 wherein the tapered line radiator has a width that linearly varies from the first line width of the tapered line radiator to the second line width of the tapered line radiator.

7. The antenna of claim 5 wherein the meander line radiator is formed on the dielectric layer top surface;

wherein the tapered line radiator is formed on the dielectric layer bottom surface; and, wherein the straight line radiator is formed on the dielectric layer bottom surface.

8. The antenna of claim 7 wherein the dielectric layer includes a conductive via between the top surface and the bottom surface;

wherein the meander line radiator output is connected to the via on the dielectric layer top surface; and, wherein the tapered line radiator input is connected to the via on the dielectric layer bottom surface.

9. The antenna of claim 8 wherein the dielectric layer has a first end and a second end, with the via located proximate to the second end;

wherein the meander line radiator input is formed at the dielectric layer first end and the output is formed at the dielectric layer second end;

wherein the tapered line radiator input is formed at the dielectric layer second end; and, wherein the straight line radiator output is located proximate to the dielectric layer first end.

10. The antenna of claim 7 wherein the combination of the meander line radiator, tapered line radiator, and straight line radiator forms a first effective electrical length corresponding to a first frequency, a second effective electrical length corresponding to a second frequency, non-harmonically related to the first frequency, and a third effective electrical length corresponding to a third frequency, non-harmonically related to the first and second frequencies.

11. The antenna of claim 10 wherein the combination of the meander line radiator, tapered line radiator, and straight line radiator forms effective electrical lengths corresponding to frequencies in the ranges of approximately 824 to 894 megahertz (MHz), 1565 to 1585 MHz, and 1850 to 1990 MHz.

12. The antenna of claim 11 wherein the meander line radiator has a line width, a first line length per turn, a second line length per turn, a line leader length, and a number of turns;

wherein the tapered line radiator has a line length; and, wherein the straight line radiator has a line length and a line width.

13. The antenna of claim 12 wherein the meander line radiator has a line width of 31.25 mils, a first line length per turn of 20 mils, a second line length per turn of 322 mils, a line leader length of 220 mils, and 13 turns;

wherein the first line width of the tapered line radiator is 322 mils;

wherein the second line width of the tapered line radiator is 31.25 mils;

wherein a line length of the tapered line radiator is 1160 mils; and, wherein the straight line radiator has a line length of 440 mils and a line width of 31.25 mils.

14. A tri-band antenna comprising:

a meander line radiator;

a tapered line radiator coupled to the meander line radiator;

a straight line radiator coupled to the tapered line radiator;

a dielectric layer having a first surface and a second surface;

wherein the meander line, tapered line, and straight line radiators are arranged on the dielectric layer first and second surfaces to provide electromagnetic coupling between at least two of the meander line, tapered line, and straight line radiators during operation.

15. The antenna of claim 14 further wherein each of said first and second surfaces having an area of less than $1.0\times10^6$ square mils ($mils^2$).

16. The antenna of claim 14 wherein the first surface is a top surface and the second surface is a bottom surface; and, wherein the meander line, tapered line, and straight line radiators are microstrip structures overlying the dielectric layer top and bottom surfaces.

17. The antenna of claim 16 wherein the meander line radiator has an input connected to a transmission line feed, and an output;

wherein the tapered line radiator has an input connected to the meander output, and an output; and, wherein the straight line radiator has an input connected to the tapered output, and an unterminated output.

18. The antenna of claim 17 wherein the tapered line radiator has a first line width and a second line width;

wherein the second line width of the tapered line radiator is less than the first line width of the tapered line radiator.

19. The antenna of claim 14 wherein the tapered line radiator has a width that linearly varies from the first line width of the tapered line radiator to the second line width of the tapered line radiator.

20. The antenna of claim 18 wherein the meander line radiator is formed on the dielectric layer top surface;

wherein the tapered line radiator is formed on the dielectric layer bottom surface; and, wherein the straight line radiator is formed on the dielectric layer bottom surface.

21. The antenna of claim 20 wherein the dielectric layer includes a conductive via between the top surface and the bottom surface;

wherein the meander line radiator output is connected to the via on the dielectric layer top surface; and, wherein the tapered line radiator input is connected to the via on the dielectric layer bottom surface.

22. The antenna of claim 21 wherein the dielectric layer has a first end and a second end, with the via located proximate to the second end;

wherein the meander line radiator input is formed at the dielectric layer first end and the output is formed at the dielectric layer second end;

wherein the tapered line radiator input is formed at the dielectric layer second end; and, wherein the straight line radiator output is located proximate to the dielectric layer first end.

23. The antenna of claim 20 wherein the combination of the meander line radiator, tapered line radiator, and straight line radiator forms a first effective electrical length corresponding to a first frequency, a second effective electrical length corresponding to a second frequency, non-harmonically related to the first frequency, and a third effective electrical length corresponding to a third frequency, non-harmonically related to the first and second frequencies.

24. The antenna of claim 23 wherein the combination of the meander line radiator, tapered line radiator, and straight line radiator forms effective electrical lengths corresponding to frequencies in the ranges of approximately 824 to 894 megahertz (MHz), 1565 to 1585 MHz, and 1850 to 1990 MHz.

25. The antenna of claim 24 wherein the meander line radiator has a line width, a first line length per turn, a second line length per turn, a line leader length, and a number of turns;

wherein the tapered line radiator has a line length; and, wherein the straight line radiator has a line length and a line width.

26. The antenna of claim 25 wherein the meander line radiator has a line width of 31.25 mils, a first line length per turn of 20 mils, a second line length per turn of 322 mils, a line leader length of 220 mils, and 13 turns;

wherein the first line width of the tapered line radiator is 322 mils;

wherein the second line width of the tapered line radiator is 31.25 mils;

wherein a line length of the tapered line radiator is 1160 mils; and, wherein the straight line radiator has a line length of 440 mils and a line width of 31.25 mils.

27. A wireless communications system comprising:

a microprocessor subsystem;

a high data rate (HDR) modem card having a first port connected to the microprocessor subsystem, an antenna port, and a card width;

a tri-band antenna connected to the HDR modem antenna port and including a meander line radiator, a tapered line radiator, and a straight line radiator overlying a dielectric layer, the tapered line radiator coupled to the meander line radiator, the straight line radiator coupled to the tapered line radiator;

wherein the meander line, tapered line, and straight line radiators are arranged on the dielectric layer to provide electromagnetic coupling between at least two of the meander line, tapered line, and straight line radiators during operation.

28. The system of claim 27 wherein the combination of the meander line radiator, tapered line radiator, and straight line radiator forms a first effective electrical length corresponding to a first frequency, a second effective electrical length corresponding to a second frequency, non-harmonically related to the first frequency, and a third effective electrical length corresponding to a third frequency, non-harmonically related to the first and second frequencies.

29. The system of claim 28 wherein the combination of the meander line radiator, tapered line radiator, and straight line radiator forms effective electrical lengths corresponding to frequencies in the ranges of approximately 824 to 894 megahertz (MHz), 1565 to 1585 MHz, and 1850 to 1990 MHz.

* * * * *